US008627523B2

(12) United States Patent
Kaiser

(10) Patent No.: US 8,627,523 B2
(45) Date of Patent: Jan. 14, 2014

(54) PORTABLE VARIABLE-POSITION HEADBOARD APPARATUS

(76) Inventor: Todd Kaiser, Bayville, NY (US)

( * ) Notice: Subject to any disclaimer, the term of this patent is extended or adjusted under 35 U.S.C. 154(b) by 0 days.

(21) Appl. No.: 13/476,097

(22) Filed: May 21, 2012

(65) Prior Publication Data

US 2013/0305459 A1 Nov. 21, 2013

(51) Int. Cl.

| | |
|---|---|
| ***A47C 31/00*** | (2006.01) |
| ***A47C 17/00*** | (2006.01) |
| ***A47C 20/00*** | (2006.01) |
| ***A47C 7/02*** | (2006.01) |
| ***A47C 15/00*** | (2006.01) |

(52) U.S. Cl.

USPC ..... 5/658; 5/53.1; 5/53.2; 5/53.3; 5/633; 5/634; 297/230.1; 297/230.14; 297/352

(58) Field of Classification Search

USPC ..... 5/53.2, 53.1, 53.3, 634, 633, 658; 297/230.1, 230.11, 230.12, 230.13, 297/230.14, 352, 16.1

See application file for complete search history.

(56) References Cited

U.S. PATENT DOCUMENTS

| | | | | | |
|---|---|---|---|---|---|
| 126,599 | A | * | 5/1872 | Waterhouse | 297/372 |
| 241,748 | A | * | 5/1881 | Strauss | 5/656 |
| 513,735 | A | * | 1/1894 | Russell | 297/183.1 |
| 878,889 | A | * | 2/1908 | Miller | 297/352 |
| 1,834,380 | A | * | 12/1931 | Cane | 5/53.2 |
| 2,071,155 | A | * | 2/1937 | Samuel | 5/658 |
| 2,271,330 | A | * | 1/1942 | Dickson | 297/362.14 |
| 2,280,231 | A | * | 4/1942 | Gulley | 297/352 |
| 2,429,795 | A | * | 10/1947 | Blanchard et al. | 297/118 |
| 2,692,012 | A | * | 10/1954 | Cramer | 297/298 |
| 2,697,233 | A | * | 12/1954 | Christenson | 5/131 |
| 2,724,127 | A | | 11/1955 | Trivas et al. | |
| 2,844,829 | A | | 7/1958 | Levy | |
| 3,066,980 | A | * | 12/1962 | Clute | 297/252 |
| 3,121,884 | A | * | 2/1964 | Emery | 5/634 |
| 3,287,746 | A | * | 11/1966 | Weddle | 5/634 |
| 3,343,185 | A | * | 9/1967 | Nemser | 5/633 |
| 3,452,372 | A | * | 7/1969 | Emery | 5/634 |
| 3,565,419 | A | * | 2/1971 | Allard et al. | 5/634 |
| 3,790,973 | A | | 2/1974 | Bradley | |
| 3,895,840 | A | * | 7/1975 | Szurszewski | 297/230.11 |
| 4,015,298 | A | | 4/1977 | Scott | |
| 4,185,342 | A | * | 1/1980 | Young | 5/634 |
| 4,793,652 | A | * | 12/1988 | Hannah et al. | 297/230.14 |
| 4,958,392 | A | | 9/1990 | Cannady | |
| 5,036,556 | A | | 8/1991 | Wieland | |

(Continued)

*Primary Examiner* — William Kelleher
*Assistant Examiner* — Eric Kurilla
(74) *Attorney, Agent, or Firm* — Gerald E. Hespos; Michael J. Porco; Matthew T. Hespos

(57) ABSTRACT

A portable variable-position headboard for a bed or the like is provided. The apparatus includes a bottom frame member having a first end and a second end, the second end including a hinge; a back support frame member having a first end and a second end, the first end having a complementary hinge for coupling the back support frame member to the hinge of the bottom frame member, the back support frame member being movable from a first, closed position to a second, open position relative to the bottom frame member; and a back board configured for supporting a back of a user, the back board being pivotably coupled to the second end of the back support frame member. In the open position, the bottom frame member can be horizontally disposed between a mattress and a support structure, e.g., a bed frame, to create a vertical headboard.

13 Claims, 4 Drawing Sheets

(56) References Cited

U.S. PATENT DOCUMENTS

| | | | | | |
|---|---|---|---|---|---|
| 5,062,676 | A * | 11/1991 | Mars | 297/338 |
| 5,353,450 | A | 10/1994 | Katan | |
| 5,385,388 | A * | 1/1995 | Faiks et al. | 297/301.3 |
| 5,553,917 | A * | 9/1996 | Adat et al. | 297/230.14 |
| 5,771,508 | A | 6/1998 | Messina | |
| 5,961,178 | A * | 10/1999 | Hodson | 297/17 |
| 6,250,712 | B1 * | 6/2001 | Livington et al. | 297/4 |
| 6,374,440 | B1 * | 4/2002 | Thim, Jr. | 5/633 |
| 6,494,539 | B2 * | 12/2002 | Frank | 297/378.1 |
| 6,910,234 | B1 | 6/2005 | Thulin | |
| 7,758,119 | B1 * | 7/2010 | Baterdouk | 297/230.1 |
| 2008/0303328 | A1 * | 12/2008 | Hogg | 297/354.13 |
| 2010/0201162 | A1 * | 8/2010 | Leywood et al. | 297/16.1 |
| 2011/0271452 | A1 * | 11/2011 | Basilone | 5/634 |

* cited by examiner

PORTABLE VARIABLE-POSITION HEADBOARD APPARATUS

BACKGROUND

1. Field

The present disclosure relates generally to beds and bedding support systems and apparatuses, and more particularly, a portable variable-position headboard for a bed or the like.

2. Description of the Related Art

Conventionally, a bed headboard comprises a vertical board or panel disposed at the head of the bed, for aesthetic reasons and with a view to minimizing drafts, preventing the displacement of pillows and providing support for a person sitting up in the bed. However, several known support structures for bedding do not include a headboard, for example, bed frames, bunk beds, etc.

Without the headboard, the support structure supports a mattress but provides no support for a person sitting up in the bed. To overcome this, a user will be required to position the support structure near a wall so the wall may support the user sitting up in bed. However, the support structure may additionally be required to be fixed to the wall to prevent movement from the wall and the potential of pillows and the user being caught between the support structure of the bed and the wall.

There are occasions when a person, while in bed, wishes to sit up to watch television, read, work, etc. Everyone has probably attempted to do this at one time or another and has found it quite difficult to remain in this reclining-seated position very long. In an attempt to make this reclining-seated position more comfortable, there have been developed tiltable or adjustable headboards for beds. However, these tiltable or adjustable headboards are required to be permanently fixed to the existing headboard, bed frame or a wall. Examples of such headboards are described and shown in U.S. Pat. Nos. 2,844,829; 5,353,450; and 5,771,508.

Additionally, bed rest pillows are known in the art, also know as husband or boyfriend pillows. A bed rest pillow is a large, high-backed pillow with two arms positioned at a lower portion of the pillow. Generally, a bed rest pillow is used to prop a user upright while in bed or on the floor, as for reading or watching television. However, due to the soft and pliable nature of this type of pillow, a bed rest pillow typically is required to be prop up against a rigid vertical surface, such as a headboard, a wall, a lower portion of a couch, etc.; otherwise, the bed rest pillow (and user) will have no support and will fall backwards when leaned upon.

Therefore, a need exists for an apparatus for supporting a user in a bed in various positions without requiring the apparatus to be permanently fixed to the bedding structure or an adjacent wall or be supported by another rigid structure.

SUMMARY

A portable variable-position headboard for a bed or the like is provided.

According to one aspect of the present disclosure, the apparatus includes a bottom frame member having a first end and a second end, the second end including a hinge; a back support frame member having a first end and a second end, the first end having a complementary hinge for coupling the back support frame member to the hinge of the bottom frame member, the back support frame member being movable from a first, closed position to a second, open position relative to the bottom frame member; and a back board configured for supporting a back of a user, the back board being pivotably coupled to the second end of the back support frame member.

In the open position, the bottom frame member can be horizontally disposed between a mattress and a support structure, e.g., a bed frame, to create a vertical headboard.

In the closed position, the bottom frame member is brought into contact with the back support frame member and can be carried via an aperture in either the bottom frame member or the back support frame member.

According to another aspect of the present disclosure, a bed assembly is provided including a generally rectangular mattress; a support structure configured to support the mattress in a horizontal position, the mattress being disposed on an upper surface of the support structure; and a variable-position headboard apparatus including: a bottom frame member having a first end and a second end, the second end including a hinge, the bottom frame member being configured to be positioned between the mattress and support structure; a back support frame member having a first end and a second end, the first end having a complementary hinge for coupling the back support frame member to the hinge of the bottom frame member, the back support frame member being movable from a first position to a second position relative to the bottom frame member; and a back board configured for supporting a back of a user, the back board being pivotably coupled to the second end of the back support frame member.

BRIEF DESCRIPTION OF THE DRAWINGS

The above and other aspects, features, and advantages of the present disclosure will become more apparent in light of the following detailed description when taken in conjunction with the accompanying drawings in which.

Figure 1:
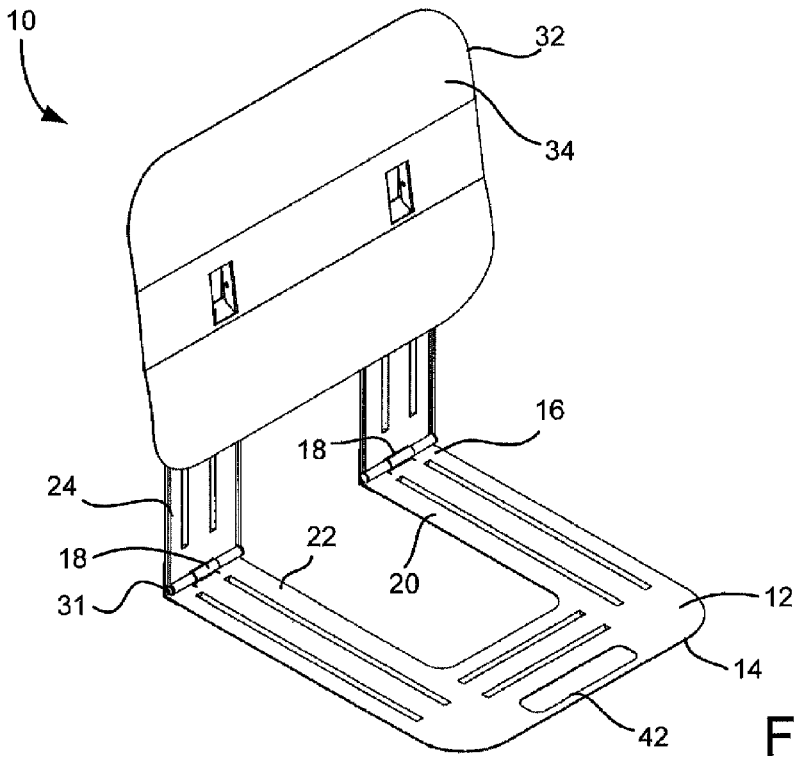
FIG. 1 is a front perspective view of a portable variable-position headboard apparatus in accordance with an embodiment of the present disclosure.

It should be understood that the drawing(s) is for purposes of illustrating the concepts of the disclosure and is not necessarily the only possible configuration for illustrating the disclosure.

DETAILED DESCRIPTION

Preferred embodiments of the present disclosure will be described hereinbelow with reference to the accompanying drawings. In the following description, well-known functions or constructions are not described in detail to avoid obscuring the present disclosure in unnecessary detail.

A portable variable-position headboard for a bed or the like is provided. The apparatus includes a bottom frame member hingedly coupled to a back support frame member including a pivoting back board. When in an open position, the bottom frame member is approximately at a right angle to the back support member. In the open position, the bottom frame member can be horizontally disposed between a mattress and a support structure, e.g., a bed frame, to create a vertical headboard. The apparatus can be folded into a closed position by moving the bottom frame member in contact with the back support member for portability.

Figure 2:
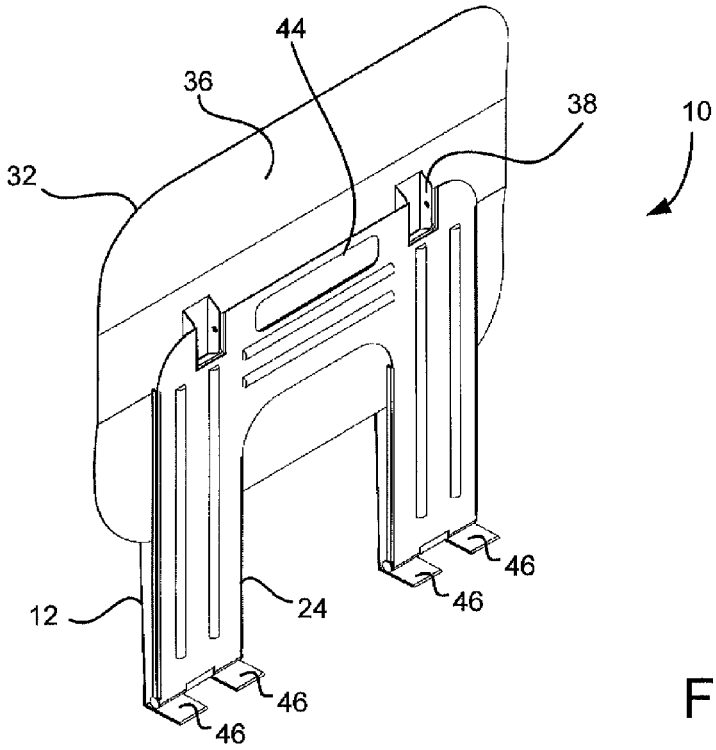
FIG. 2 is a rear perspective view of a portable variable-position headboard apparatus in accordance with an embodiment of the present disclosure.
Figure 3:
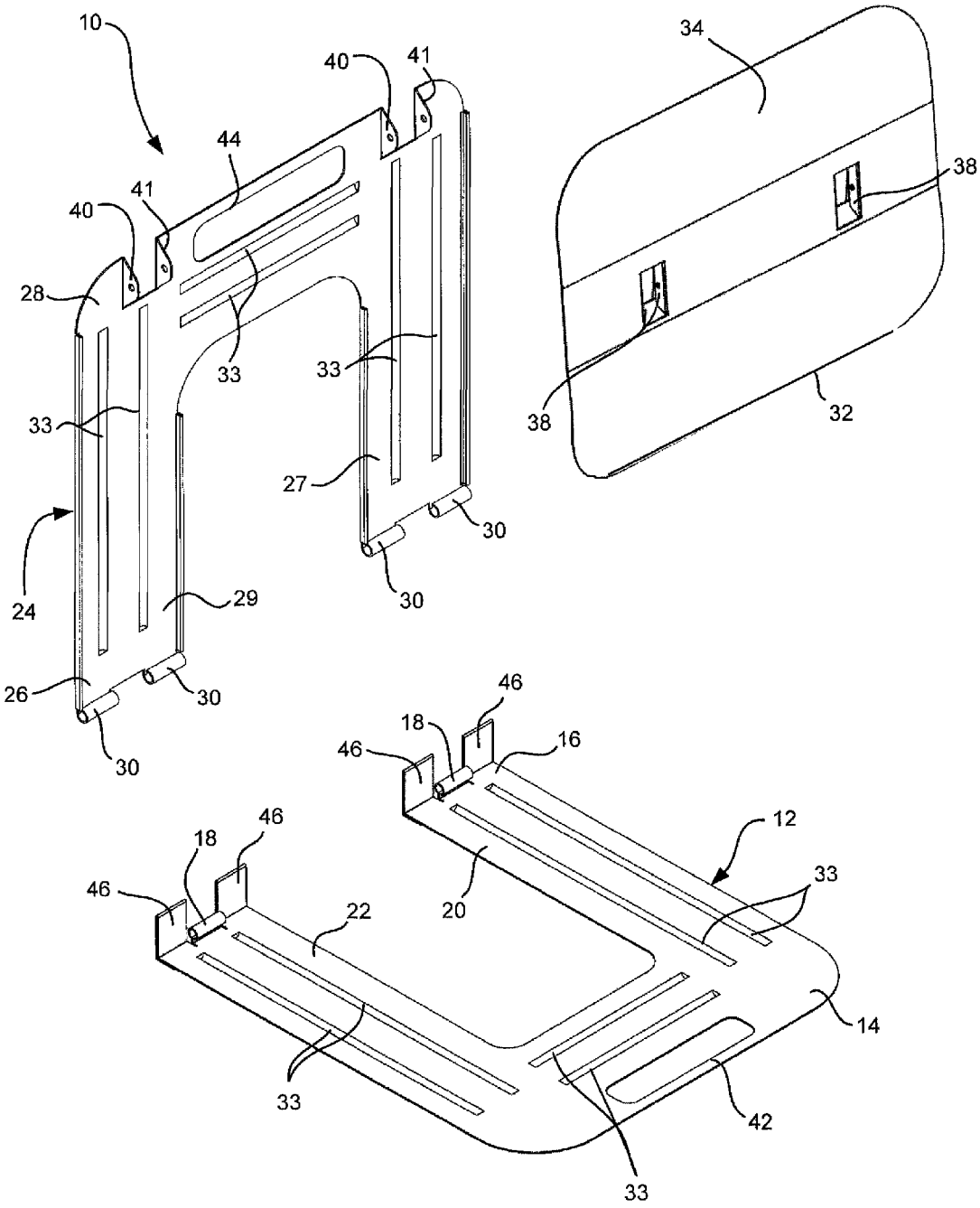
FIG. 3 is an exploded view of a portable variable-position headboard apparatus in accordance with an embodiment of the present disclosure.

Referring to the FIGS. 1-3, a portable variable-position headboard 10 for a bed or the like is illustrated. The apparatus 10 includes a bottom frame member 12 having a first end 14 and a second end 16. The bottom frame member 12 is generally planar and is configured to be positioned below a mattress or between a mattress and bed frame, as will be described in more detail below. The second end 16 of the bottom frame member 12 includes a hinge 18.

Figure 4:
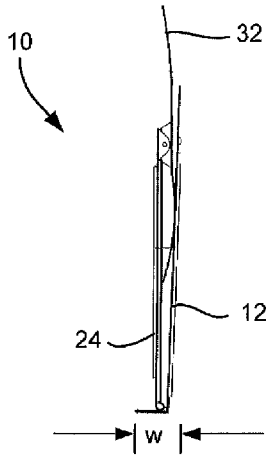
FIG. 4 is a side view of a portable variable-position headboard apparatus in a closed position in accordance with an embodiment of the present disclosure.
Figure 5:
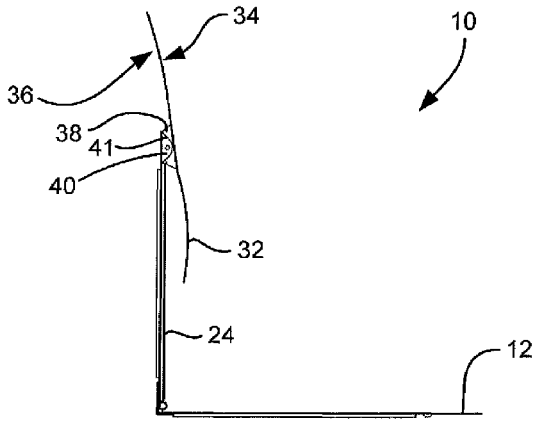
FIG. 5 is a side view of a portable variable-position headboard apparatus in an open position in accordance with an embodiment of the present disclosure.

The apparatus 10 further includes a back support frame member 24 having a first end 26 and a second end 28. The first end 26 of the back support frame member 24 includes a complementary hinge 30 for coupling the back support frame member 24 to the hinge 18 of the bottom frame member 12. Hinges 18 and 30 are coupled via a pin 31 or other suitable means. By providing hinges 18, 30, the back support frame member 24 is movable from a first position to a second position relative to the bottom frame member 12. As shown in FIGS. 4 and 5, the apparatus 10 can be folded into the first position to be carried and/or for storage (FIG. 4) and can be opened into a second position for use with a bed (FIG. 5).

In one embodiment, the bottom frame member 12 is configured as a U-shaped frame member having leg portions 20, 22. In this embodiment, a hinge 18 is provided on each leg member 20, 22 adjacent to the second end 16 of the bottom frame member 12. Additionally, in this embodiment, the back support frame member 24 may be configured as a U-shaped frame member having leg portions 27, 29 corresponding to leg portions 20, 22 of the bottom frame member 12. In this embodiment, complementary hinge 30 will be provided on both leg portions 27, 29 to be coupled to hinge 18 on leg portions 20, 22.

It is to be appreciated that the bottom frame member 12 and back support frame member 24 may take other forms and shapes. For example, the bottom frame member 12 and back support frame member 24 may be configured as a rigid planar, generally rectangular member, where each of the bottom frame member 12 and back support frame member 24 includes at least one hinge. In another embodiment, the bottom frame member 12 and back support frame member 24 may be configured as a rectangular or cylindrical tubular member. In this embodiment, each of the bottom frame member 12 and back support frame member 24 may be configured from a single linear rectangular or cylindrical tubular member which is bent or manipulated by any known technique. An appropriate hinge or hinge member may then be welded or attached by any known means to each of the bottom frame member 12 and back support frame member 24.

In a further embodiment, the bottom frame member 12 and back support frame member 24 may be constructed of one piece with a 90 degree angle fixed position. For example, the bottom frame member 12 and back support frame member 24 may be formed from a single, generally rectangular piece of sheet metal which is bent at a midway point along the generally rectangular piece to an angle of approximately 90 degrees. As another example, the bottom frame member 12 and back support frame member 24 may be configured from a single linear rectangular or cylindrical tubular member which is bent or manipulated by any known technique to form a unitary structure having a bottom portion and back support portion at approximately a 90 degree angle relative to each other.

A back board 32 configured for supporting a back of a user is variably coupled to the second end 28 of the back support frame member 24. The back board 32 is generally rectangular and includes a front surface 34 and a back surface 36. A hinge member 38 is disposed on the back surface 36 of the back board 32 and is configured to pivotably mate to hinge bracket 40 disposed on the back support frame member 24 at the second end 28. By providing hinge member 38 and hinge bracket 40, the back board 32 is enabled to pivot relative to the back support frame member 24 from an angle of about 0 degrees to about 35 degrees. It is to be appreciated that the hinge bracket 40 is angled at a top end 41 to act as a limit to prevent the back board 32 from pivoting more than about 35 degrees. It is further to be appreciated that the angle of the top end 41 may be configured at various angles to shorten or broaden the range of pivot.

In one embodiment, the back board may be mounted to the back support frame member 24 in a fixed, non-pivoting configuration. In this embodiment, the back board 32 may be welded or attached by any known means to back support frame member 24. It is to be appreciated that the back board 32 may be fixed to the back support frame member 24 at a predetermined angle, from about 0 degrees to about 35 degrees.

The back board 32 may be constructed from a heavy gauge sheet metal, plastic, etc. It is to be appreciated that the back board 32 may be contoured to enhance comfort of the user. The back board 32 may also be provided with a cover which may incorporate padding, foam, etc. In one embodiment, the cover may be applied to the front surface 34 of the back board 32 by an known means such as an adhesive. In another embodiment, the cover may be configured from an elastic material which is stretch-fit over the back board 32. In this embodiment, the cover may be removable or replaceable.

Referring to FIG. 4, a side view of the apparatus 10 in a closed position is illustrated, while FIG. 5 illustrates a side view of the apparatus 10 in an open position. While in the closed position, the hinge 18 and complementary hinge 30 enable the bottom frame member 12 to be fold up and come into close contact with the back support frame member 24 and back board 32. In the closed position, the apparatus 10 is configured to have a width w of only a few inches making is suitable for easy storage, for example, under a bed. Furthermore, in the closed position, the apparatus 10 is portable and can be easily carried from one location to another. To enhance the portability of the apparatus, an aperture 42 configured to accept a hand of a user is provided in the bottom frame member 12 and a similar aperture 44 configured to accept a hand of a user is provided in the back support frame member 24. When in the closed position, either aperture 42 or aperture 44 may be employed to carry the apparatus 10 in a vertical direction, for example, similar to a briefcase or luggage.

Figure 6A:
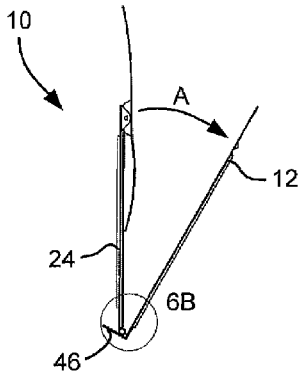
FIG. 6A illustrates a view of an operation of opening the apparatus from a first position to a second position, with FIG. 6B illustrating an enlarged sectional view taken from FIG. 6A.
Figure 7A:
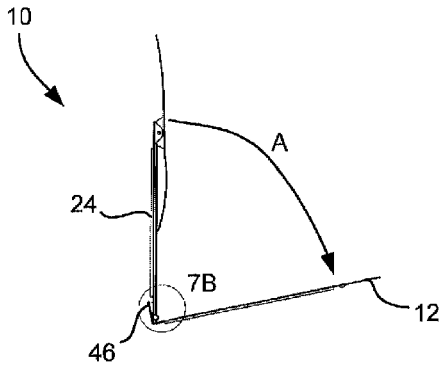
FIG. 7A illustrates another view of an operation of opening the apparatus from a first position to a second position, with FIG. 7B illustrating an enlarged sectional view taken from FIG. 7A.
Figure 6B:
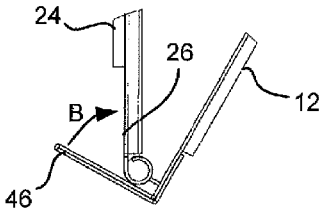
Figure 7B:
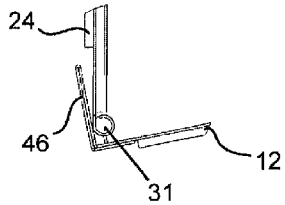

To open the apparatus 10, the bottom frame member 12 is moved away from the back support frame member 24 as indicated by arrow A, as shown in FIGS. 6A and 7A. As can be seen more clearly in FIGS. 6B and 7B, a stop member 46 is provided at the second end 16 of the bottom frame member 12. The stop member 46 is substantially fixed at a right angle, or about 90 degrees, relative to the general plane that the bottom frame member 12 lies in. As the bottom frame member 12 is moved away from the back support frame member 24, the stop member 46 moves toward the first end 26 of the back support frame member 24 as indicated by arrow B. When the bottom frame member 12 is about 90 degrees relative to the back support frame member 24, the stop member 46 will come into contact with the first end 26 of the back support frame member 24 preventing further movement. The resulting structure in the fully open position is shown in FIG. 5. As will be described below, by providing the stop members 46, a user will be rigidly supported by the back board 32 and back support frame member 24 when the apparatus is employed with a bed.

Figure 8:
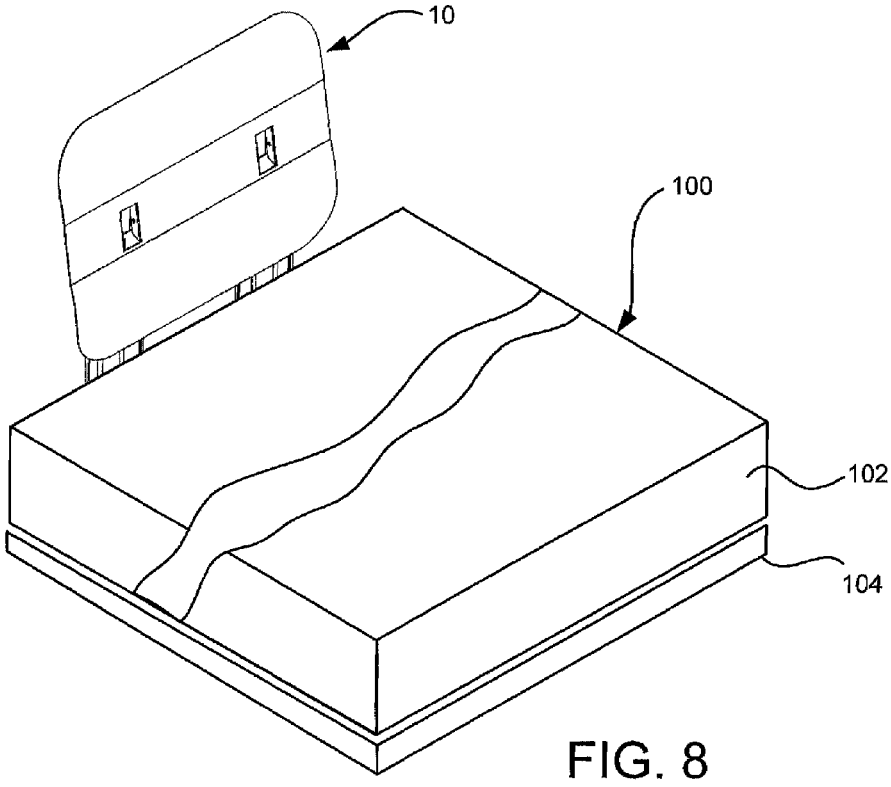
FIG. 8 is a perspective view of a portable variable-position headboard apparatus positioned on a bed in accordance with an embodiment of the present disclosure.
Figure 9:
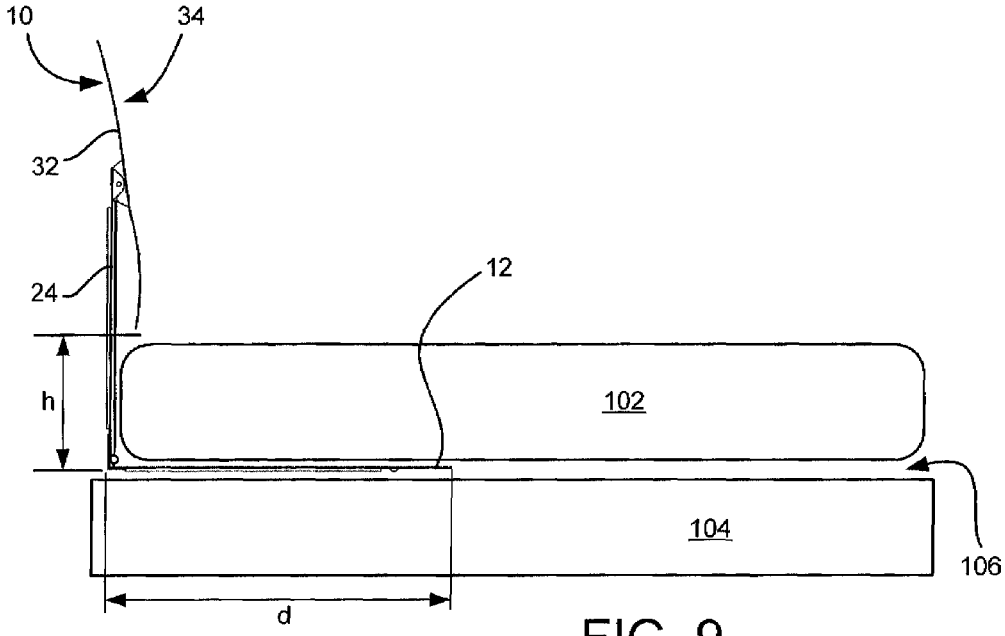
FIG. 9 is a side view of a portable variable-position headboard apparatus positioned on a bed in accordance with an embodiment of the present disclosure.

FIG. 8 is a perspective view of the portable variable-position headboard apparatus 10 positioned on a bed 100 in accordance with an embodiment of the present disclosure and FIG. 9 is a side view of the portable variable-position headboard apparatus positioned on a bed 100. The bed 100 includes at least a mattress 102 and a support structure 104. The support structure 104 may be a box spring or a bed frame which simply supports the mattress 102 but does not have a permanent headboard coupled thereto. To mount the apparatus 10 to the bed, the apparatus 10 is configured in the open position. In the open position, the bottom frame member 12 is positioned or slid in a the space 106 between the mattress 102 and support structure 104. The weight of the mattress 102 will maintain the apparatus 10 in a position where the back support frame member 24 is substantially perpendicular to the mattress 102. It is to be appreciated that the back board 32 is coupled to the back support frame member 24 at at least height h, so the back board may tilt without coming into contact with the mattress 102. Furthermore, the depth d of the bottom frame member 12 may range from about one quarter of the total length of the mattress 102 to over one half of the total length of the mattress.

In a further embodiment, the bottom frame member 12 and back support member 24 are provided with a plurality of grooves 33. The plurality of grooves 33 are provided to strengthen each of the bottom frame member 12 and back support member 24 and prevent them from bending when a user rests upon the back board 32 of the apparatus. Additionally, the plurality of grooves 33 provided on the bottom frame member 12 will create a friction fit between the mattress 102 and support structure 104, thereby, preventing the apparatus 10 from slipping once disposed in space 106.

While the disclosure has been shown and described with reference to certain preferred embodiments thereof, it will be understood by those skilled in the art that various changes in form and detail may be made therein without departing from the spirit and scope of the disclosure.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

What is claimed is:

1. A variable-position headboard apparatus comprising:

a bottom frame member having a first end and a second end, the second end including a hinge;

a back support frame member having a first end and a second end, the first end having a complementary hinge for coupling the back support frame member to the hinge of the bottom frame member, the back support frame member being movable from a first position to a second position relative to the bottom frame member; and a generally rectangular back board configured for supporting a back of a user, the back board including at least one hinge member disposed on a midpoint of a back surface of the back board and configured to pivotably mate to at least one hinge bracket disposed on the back support frame member at the second end, wherein a too end of the back board pivots beyond the second end of the back support member and the at least one hinge bracket of the back support frame is angled at a top end to act as a limit to prevent the back board from pivoting more than a predetermined angle beyond the second end of the back support member when the back surface of the back board comes into contact with the angled top end of the at least one hinge bracket.

2. The apparatus of claim 1, wherein in the first position the bottom frame member is in contact with the back support frame member.

3. The apparatus of claim 2, wherein in the second position the bottom frame member is about 90 degrees relative to the back support frame member.

4. The apparatus of claim 3, wherein the bottom frame member includes a stop member configured to limit the movement of the back support frame member.

5. The apparatus of claim 2, wherein the bottom frame member includes an aperture configured to accept a hand of a user for carrying the apparatus.

6. The apparatus of claim 2, wherein the back support frame member includes an aperture configured to accept a hand of a user for carrying the apparatus.

7. The apparatus of claim 1, wherein the back board is enabled to pivot relative to the back support frame member from an angle of about 0 degrees to about 35 degrees.

8. The apparatus of claim 1, further comprising a plurality of grooves provided on the bottom frame member so as to create a friction fit between a mattress and support structure when the bottom frame member is disposed therebetween.

9. The apparatus of claim 1, wherein the bottom frame member is configured as a U-shaped frame member having first and second leg portions, each leg portion of the bottom frame member including a hinge adjacent to the second end of the bottom frame member;

wherein the back support frame member being configured as a U-shaped frame member having first and second leg portions corresponding to the first and second leg portions of the bottom frame member, each leg portion of the back support frame member including a complementary hinge adjacent to the first end of the back support frame member coupled to the corresponding hinges on leg portions of the bottom frame member; and wherein the back board being pivotably coupled to the second end of the back support frame member.

10. A bed assembly comprising:

a generally rectangular mattress;

a generally rectangular support structure configured to support the mattress in a horizontal position, the mattress being disposed on an upper surface of the generally rectangular support structure; and a variable-position headboard apparatus including:

at least one bottom frame member having a first end and a second end, the at least one bottom frame member being configured to be positioned between the mattress and the support structure;

at least one back support frame member having a first end and a second end, the first end of the at least one back support frame member being fixed to the second end of the at least one bottom frame member at a first predetermined angle; and a back board configured for supporting a back of a user, the back board including at least one hinge member disposed on a midpoint of a back surface of the back board and configured to pivotably mate to at least one hinge bracket disposed on the at least one back support frame member at the second end, wherein a top end of the back board pivots beyond the second end of the at least one back support member and the at least one hinge bracket of the at least one back support frame is angled at a top end to act as a limit to prevent the back board from pivoting more than a predetermined angle beyond the second end of the at least one back support member when the back surface of the back board comes into contact with the angled top end of the at least one hinge bracket, and wherein the weight of the mattress maintains the variable-position headboard apparatus in a position where the at least one back support frame member is substantially perpendicular to the horizontal mattress.

11. A variable-position headboard apparatus comprising:

at least one bottom frame member having a first end and a second end;

at least one back support frame member having a first end and a second end;

the first end of the at least one back support frame member being fixed to the second end of the at least one bottom frame member at a first predetermined angle; and a generally rectangular back board configured for supporting a back of a user, the back board including at least one hinge member disposed on a midpoint of a back surface of the back board and configured to pivotably mate to at least one hinge bracket disposed on the at least one back support frame member at the second end, wherein a top end of the back board pivots beyond the second end of the at least one back support member and the at least one hinge bracket of the at least one back support frame is angled at a top end to act as a limit to prevent the back board from pivoting more than a predetermined angle beyond the second end of the at least one back support member when the back surface of the back board comes into contact with the angled top end of the at least one hinge bracket.

12. The apparatus of claim 11, wherein the first predetermined angle is about 0 degrees to about 90 degrees.

13. The apparatus of claim 11, wherein the back board is enabled to pivot relative to the at least one back support frame member from an angle of about 0 degrees to about 35 degrees.

* * * * *